US007342473B2

(12) United States Patent
Joung et al.

(10) Patent No.: US 7,342,473 B2
(45) Date of Patent: Mar. 11, 2008

(54) METHOD AND APPARATUS FOR REDUCING CANTILEVER STRESS IN MAGNETICALLY ACTUATED RELAYS

(75) Inventors: Junho Joung, Eagan, MN (US); Jun Shen, Phoenix, AZ (US); Cheng Ping Wei, Gilbert, AZ (US)

(73) Assignee: Schneider Electric Industries SAS, Rueil-Malmaison (FR)

( * ) Notice: Subject to any disclaimer, the term of this patent is extended or adjusted under 35 U.S.C. 154(b) by 208 days.

(21) Appl. No.: 11/100,637

(22) Filed: Apr. 7, 2005

(65) Prior Publication Data

US 2006/0082427 A1 Apr. 20, 2006

Related U.S. Application Data

(60) Provisional application No. 60/559,978, filed on Apr. 7, 2004.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 4,065,677 | A | | 12/1977 | Micheron et al. |
| 4,461,968 | A | | 7/1984 | Kolm et al. |
| 4,480,162 | A | * | 10/1984 | Greenwood ..... 200/181 |
| 4,496,211 | A | | 1/1985 | Daniel |
| 4,570,139 | A | | 2/1986 | Kroll |
| 4,755,706 | A | | 7/1988 | Harnden, Jr. et al. |
| 5,016,978 | A | | 5/1991 | Fargette et al. |
| 5,048,912 | A | | 9/1991 | Kunikane et al. |
| 5,398,011 | A | | 3/1995 | Kimura et al. |

(Continued)

FOREIGN PATENT DOCUMENTS

DE 198 20 821 C1 12/1999

(Continued)

OTHER PUBLICATIONS

English-Language Abstract of WO 9927548, published Jun. 3, 1999, 1 page.
Richard P. Feymann, "There's Plenty of Room at the Bottom", Dec. 29, 1959, pp. 1-12, Internet Source: http://222.zyvex.com/nanotech/feynman.html.
E. Fullin, J. Gobet, H.A.C. Tilmans, and J. Bergvist, "A New Basic Technology for Magnetic Micro-Actuators", pp. 143-147.

(Continued)

*Primary Examiner*—Elvin Enad
*Assistant Examiner*—Bernard Rojas
(74) *Attorney, Agent, or Firm*—Sterne, Kessler, Goldstein & Fox P.L.L.C.

(57) ABSTRACT

Methods, systems, and apparatuses are disclosed for magnetically-actuated relays/switches that suppress cantilever and/or hinge deformation. A permanent magnet produces a first magnetic field. A movable element is held between a pair of axially-aligned, rotationally flexible hinges. A space is present between the permanent magnet and the movable element. The space allows at least one end portion of the movable element to move toward the permanent magnet. A bar member is positioned in the space. A coil produces a second magnetic field to switch the moveable element between first and second stable states. At least the central portion of the movable element is magnetically attracted toward the permanent magnet. The bar member physically prevents the central portion of the movable element from flexing toward the permanent magnet due to the magnetic attraction.

22 Claims, 12 Drawing Sheets

U.S. PATENT DOCUMENTS

| | | | | |
|---|---|---|---|---|
| 5,454,904 | A | 10/1995 | Ghezzo et al. | |
| 5,472,539 | A * | 12/1995 | Saia et al. | 156/155 |
| 5,475,353 | A * | 12/1995 | Roshen et al. | 335/78 |
| 5,557,132 | A | 9/1996 | Takahashi | |
| 5,629,918 | A | 5/1997 | Ho et al. | |
| 5,696,619 | A | 12/1997 | Knipe et al. | |
| 5,784,190 | A | 7/1998 | Worley | |
| 5,818,316 | A | 10/1998 | Shen et al. | |
| 5,838,847 | A | 11/1998 | Pan et al. | |
| 5,847,631 | A | 12/1998 | Taylor et al. | |
| 5,898,515 | A | 4/1999 | Furlani et al. | |
| 5,945,898 | A | 8/1999 | Judy et al. | |
| 5,982,554 | A | 11/1999 | Goldstein et al. | |
| 6,016,092 | A | 1/2000 | Qiu et al. | |
| 6,016,095 | A | 1/2000 | Herbert | |
| 6,028,689 | A | 2/2000 | Michalicek et al. | |
| 6,078,016 | A | 6/2000 | Yoshikawa et al. | |
| 6,084,281 | A | 7/2000 | Fullin et al. | |
| 6,094,116 | A | 7/2000 | Tai et al. | |
| 6,094,293 | A | 7/2000 | Yokoyama et al. | |
| 6,115,231 | A | 9/2000 | Shirakawa | |
| 6,124,650 | A * | 9/2000 | Bishop et al. | 310/40 MM |
| 6,143,997 | A | 11/2000 | Feng et al. | |
| 6,160,230 | A | 12/2000 | McMillan et al. | |
| 6,297,072 | B1 | 10/2001 | Tilmans et al. | |
| 6,410,360 | B1 | 6/2002 | Steenberge | |
| 6,511,894 | B2 | 1/2003 | Song | |
| 2003/0151479 | A1 * | 8/2003 | Stafford et al. | 335/78 |

FOREIGN PATENT DOCUMENTS

| | | | |
|---|---|---|---|
| DE | 100 31 569 | A1 | 2/2001 |
| EP | 0 452 012 | A2 | 10/1991 |
| EP | 0 452 012 | A3 | 10/1991 |
| EP | 0 685 864 | A1 | 12/1995 |
| EP | 0 709 911 | A2 | 5/1996 |
| EP | 0 780 858 | A1 | 6/1997 |
| EP | 0 869 519 | A1 | 10/1998 |
| EP | 0 887 879 | A1 | 12/1998 |
| FR | 2 572 546 | | 5/1986 |
| JP | 54-161952 | | 12/1979 |
| JP | 4-275519 | | 10/1992 |
| JP | 6-251684 | | 9/1994 |
| WO | WO 97/39468 | | 10/1997 |
| WO | WO 98/34269 | | 8/1998 |
| WO | WO 99/27548 | | 6/1999 |

OTHER PUBLICATIONS

Jack. W. Judy and Richard S. Muller "Magnetically Actuated, Addressable Microstructures", Sep. 1997, Journal of Microeletromechanical Systems, vol. 6, No. 3, Sep. 1997, pp. 249-255.

Ezekiel JJ Kruglick and Kristofer SJ Pister, "Project Overview: Micro-Relays", Tech. Digital Solid-State Sensor and Actuator Workshop, 1998, Hilton Head 98 and 19th International Conference on Electric Contact Phenomena, Nuremberg, Germany, Sep. 1998 (Downloaded from Internet Source: http://www-bsac.eecs.berkeley.edu/Kruglick/relays/relays.html, on Jul. 12, 1999) 2 pgs.

Ezekiel J.J. Kruglick and Kristofer S.J. Pister, "Bistable MEMS Relays and Contact Characterization", Tech. Digital Solid-State Sensor and Actuator Workshop, Hilton Head, 1988 and 19th International Conference on Electric Contact Phenomena, Nuremberg, Germany, Sep. 1998, 5 pgs.

Laure K. Lagorce and Oliver Brand, "Magnetic Microactuators Based on Polymer Magnets", Mar. 1999, IEEE Journal of Microelectromechanical Systems, IEEE, vol. 8, No. 1, Mar. 1999, 8 pages.

"P10D Elcetricity & Magnetism Lecture 14", Internet Source: http://scitec.uwhichill.edu.bb/cmp/online/P10D/Lecture14/lect14.htn, Jan. 3, 2000, pp. 1-5.

"Ultraminiature Magnetic Latching to 5-relays SPDT DC TO C Band", Series RF 341, product information from Teledyne Relays, 1998.

M. Ruan et al., "Latching Microelectromagnetic Relays", Sensors and Actuators A 91 (Jul. 15, 2001), Copyright 2001 Elsevier Science B.V., pp. 346-350.

Xi-Qing Sun, K.R. Farmer, W.N. Carr, "A Bistable Microrelay Based on Two-Segment Multimorph Cantilever Actuators", 11th Annual Workshop on Micro Electrical Mechanical Systems, Heidelberg, Germany, IEEE, Jan. 25-29, 1998, pp. 154-159.

William P. Taylor and Mark G. Allen, "Integrated Magnetic Microrelays: Normally Open, Normally Closed, and Multi-Pole Devices", 1997 International Conference on Solid-State Sensors and Actuators, IEEE, Jun. 16-19, 1997, pp. 1149-1152.

William P. Taylor, Oliver Brand, and Mark G. Allen. "Fully Integrated Magnetically Actuated Micromachined Relays", Journal of Microelectromechanical Systems, IEEE, vol. 7, No. 2, Jun. 1998, pp. 181-191.

Tilmans, et al., "A Fully-Packaged Electromagnetic Microrelay", Proc. MEMS '99, Orlando, FL, Jan. 17-21, 1999, copyright IEEE 1999, pp. 25-30.

William Trimmer, "The Scaling of Micromechanical Devices", Internet Source: http:// home.earthlink.net/-trimmerw/mems/scale.html on Jan. 3, 2000 (adapted from article Microrobots and Micromechanical Systems by W.S.N. Trimmer, Sensors and Actuators, vol. 19, No. 3, Sep. 1989, pp. 267-287, and other sources).

John A. Wright and Yu-Chong Tai, "Micro-Miniature Electromagnetic Switches Fabricated Using MEMS Technology", Proceedings: 46th Annual International Relay Conference: NARM '98, Apr. 1998, pp. 13-1 to 13-4.

John A. Wright, Yu-Chong Tai and Gerald Lilienthal, "A Magnetostatic MEMS Switch for DC Brushless Motor Commutation", Proceedings Soild State Sensor and Actuator Workshop, Hilton Head, 1998, Jun. 1998, pp. 304-307.

John A. Wright, Yu-Chon Tai and Shih-Chia Chang, "A Large-Force, Fully Integrated MEMS Magnetic Actuator", Tranducers '97, 1997 International Conference on Solid State Sensors and Actuators, Chicago, Jun. 16-19, 1997.

Ahn, Chong H. & Allen, Mark G., A Fully Integrated Micromagnetic Actuator With A Multilevel Meander Magnetic Core, 1992 IEEE, Solid-State Sensor and Actuator Workshop, Technical Digest, Hilton Head Island, South Carolina, Jun. 22-25, 1992, Technical Digest, pp. 14-17.

English-Language Abstract of DE 10031569, published Feb. 1, 2001, 1 page.

English-Language Abstract of DE 19820821, published Dec. 16, 1999, 1 page.

English-Language Abstract of EP 0780858, published Jun. 25, 1997, 1 page.

English-Language Abstract of EP 0869519, published Oct. 7, 1998, 1 page.

English-Language Abstract of FR 2572546, published May 2, 1986, 1 page.

English-Language Abstract of JP 4275519, published Oct. 1, 1992, 1 page.

English-Language Abstract of JP 6251684, published Sep. 9, 1994, 1 page.

English-Language Abstract of JP 54161952, published Dec. 22, 1979, 1 page.

McBride, J.W., "Electrical Contact Bounce In Medium-Duty Contacts", IEEE Transactions on Components, Hybrids, and Manufacturing Technology, vol. 12, No. 1, Mar. 1989, pp. 82-90.

Mapps, D. J. et al., "Design Optimization of Rocker-Switch Dynamics to Reduce Pivot Bounce and the Effect of Load Current in Modifying Bounce Characteristics", IEEE Transactions on Components, Hybrids, and Manufacturing Technology, vol. CHMT-9, No. 3, Sep. 1986, pp. 258-264.

* cited by examiner

FIG. 7B
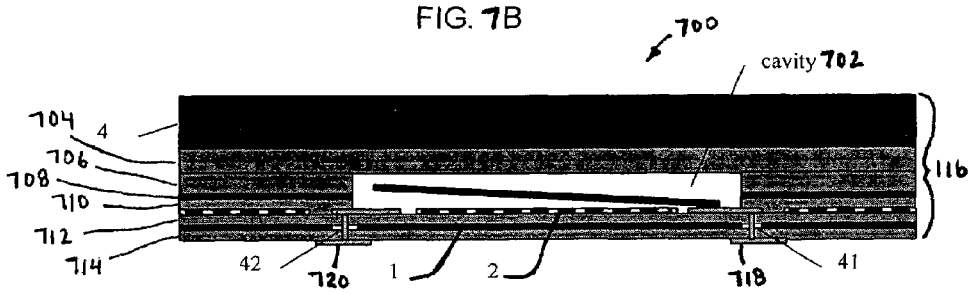
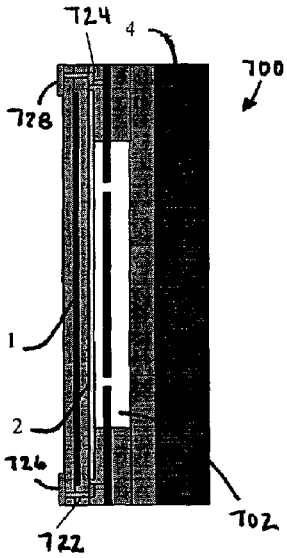
FIG. 7C
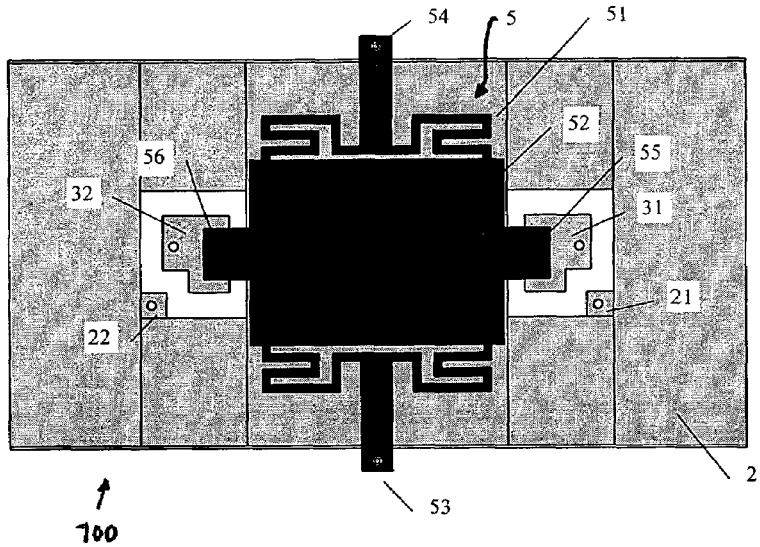
FIG. 7A

METHOD AND APPARATUS FOR REDUCING CANTILEVER STRESS IN MAGNETICALLY ACTUATED RELAYS

This application claims the benefit of U.S. provisional application Ser. No. 60/559,978, filed Apr. 7, 2004, which is incorporated herein by reference in its entirety.

BACKGROUND OF THE INVENTION

1. Field of the Invention

The present invention relates to electro-mechanical systems, including laminated electro-mechanical systems (LEMS). More specifically, the present invention relates to micro-magnetic relays/switches.

2. Background Art

Switches are typically electrically controlled two-state devices that open and close contacts to effect operation of devices in an electrical or optical circuit. Relays, for example, typically function as switches that activate or de-activate portions of electrical, optical or other devices. Relays are commonly used in many applications including telecommunications, radio frequency (RF) communications, portable electronics, consumer and industrial electronics, aerospace, and other systems. More recently, optical switches (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that energizes an armature to make or break an electrical contact. When the magnet is de-energized, a spring or other mechanical force typically restores the armature to a quiescent position.

Such relays typically exhibit a number of marked disadvantages, however, in that they generally exhibit only a single stable output (i.e., the quiescent state) and they are not latching (i.e., they do not retain a constant output as power is removed from the relay). Moreover, the spring required by conventional micro-magnetic relays may degrade or break over time. Furthermore, the cantilevers may become warped or damaged due to the ever-present magnetic attraction of the permanent magnet.

What is desired are electro-mechanical devices, including latching micro-magnetic switches, that are reliable, simple in design, low-cost and easy to manufacture, and durable. Hence, what is further desired is improved methods and systems for manufacturing electro-mechanical devices.

BRIEF SUMMARY OF THE INVENTION

Methods, systems, and apparatuses are disclosed for magnetically-actuated relays/switches that suppress cantilever and/or hinge deformation due to the magnetic attraction of a permanent magnet of the relay/switch.

In an aspect of the present invention, an electro-magnetic relay is described. A permanent magnet produces a first magnetic field. A movable element is held between a pair of axially-aligned, rotationally flexible hinges. A space is present between the permanent magnet and the movable element. The space allows at least one end portion of the movable element to move toward the permanent magnet. A bar member is positioned in the space. A coil produces a second magnetic field to switch the moveable element between first and second stable states. At least the central portion of the movable element is magnetically attracted toward the permanent magnet. The bar member physically prevents the central portion of the movable element from flexing toward the permanent magnet due to the magnetic attraction.

This arrangement can act to reduce stress and extend the lifetime of the moveable element (such as a cantilever).

The present invention is applicable to any type of micro-magnetic switch/relay. In a further aspect of the present invention, the relay may be a laminated electro-mechanical system (LEMS) type switch. The relay includes a stack of layers. The stack includes a permanent magnet layer, a layer having a movable element (such as a cantilever), a spacer layer, and a layer having a coil. The permanent magnet layer produces a first magnetic field. The movable element is held between a pair of axially-aligned, rotationally flexible hinges. The spacer layer is positioned between the permanent magnet layer and the layer having the movable element. The spacer layer has an opening formed therein and a bar member. The opening is formed to allow at least one end portion of the movable element to move into a plane of the spacer layer. The coil produces a second magnetic field to switch the moveable element between first and second stable states. At least the central portion of the movable element is magnetically attracted toward the permanent magnet layer. The bar member physically prevents the central portion of the movable element from flexing toward the permanent magnet layer due to the magnetic attraction of the permanent magnet.

These and other objects, advantages and features will become readily apparent in view of the following detailed description of the invention.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

FIGS. 7A-7C show views of a laminated electro-mechanical system, according to an embodiment of the present invention.

Figure 1:
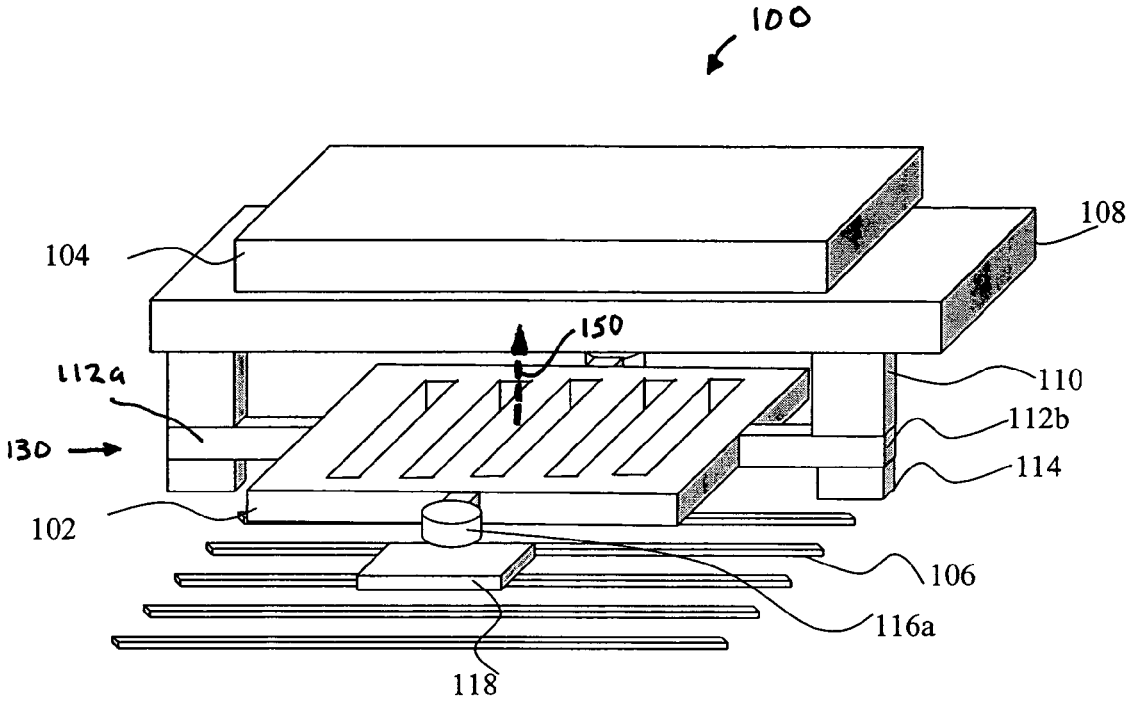
FIG. 1 shows a perspective view of the structure of a magnetically-actuated relay or switch.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Introduction

The present invention relates to switches having a cantilever structure that operates according to a magnetic actuation mechanism. The magnetic actuation mechanism includes a permanent magnet and a controllably intermittent source of magnetism, such as a coil/electromagnet.

The permanent magnet is positioned closely adjacent to the cantilever, and the magnetic field produced by the permanent magnet holds the cantilever in a particular state. When current passes through a coil adjacent to the cantilever, it generates a magnetic field that magnetizes the cantilever beam. The cantilever is suspended on a torsion spring hinge. The generated magnetic field causes the cantilever to move and change states. After changing states, the magnetic field of the permanent magnet holds the cantilever in the new state. Because of the magnetic property of the cantilever, the cantilever is constantly attracted toward the nearby permanent magnet. The ever-present magnetic attraction of the cantilever toward the permanent magnet causes tensile stress across the cantilever and hinge structure(s) constantly, regardless of whether or not the device is in operation. This force of attraction on the hinges of the cantilever causes deformation of the cantilever beam.

The present invention solves this problem with a deformation suppressing bar member positioned in a space above the cantilever. This structure can be fabricated along the hinge line, for example, and keeps the distance between a cover layer and the cantilever at designated value, to block the "pulling" of the cantilever beam by the magnetic attraction of the permanent magnet.

It should be appreciated that the particular implementations shown and described herein are examples of the invention and are not intended to otherwise limit the scope of the present invention in any way. Indeed, for the sake of brevity, conventional electronics, manufacturing, laminated electro-mechanical and MEMS technologies and other functional aspects of the systems (and components of the individual operating components of the systems) may not be described in detail herein. Furthermore, for purposes of brevity, the invention is frequently described herein as pertaining to a micro-electronically-machined relay for use in electrical or electronic systems. It should be appreciated that the manufacturing techniques described herein could be used to create mechanical relays, optical relays, any other switching device, and other component types. Further, the techniques would be suitable for application in electrical systems, optical systems, consumer electronics, industrial electronics, wireless systems, space applications, or any other application.

The term vertical, as used herein, means substantially orthogonal to the surface of a substrate. Moreover, it should be understood that the spatial descriptions (e.g., "above", "below", "up", "down", "top", "bottom", etc.) made herein are for purposes of illustration only, and that practical latching relays can be spatially arranged in any orientation or manner.

Embodiments for Reducing Stress in Moveable Elements

FIG. 1 shows a perspective view of the structure of a magnetically-actuated relay or switch 100. Switch 100 includes a cantilever 102 (i.e., a moveable element) held in a layer 130, a permanent magnet 104, a coil 106, a cover plate layer 108, a first spacer layer 110, first and second hinges 112*a* and 112*b*, a second spacer layer 114, first and second cantilever contacts 116*a* and 116*b*, a first substrate contact 118, and a second substrate contact (not shown in FIG. 1).

The operation of example magnetically-actuated switches, such as switch 100, is described in further detail below, in a subsection titled "Overview of a Latching Switch" and subsequent subsections, although the present invention is also applicable to other types of magnetically actuated switches. Thus, all details of the operation of switch 100 may not be discussed in the present section, for reasons of brevity. Furthermore, switch 100 is shown as a laminated electro-mechanical system (LEMS) type switch, for illustrative purposes, although the present invention is not limited to this type of switch. Further description is provided below in a subsection titled "Assembling Laminated Electro-Mechanical Structures According To The Present Invention," for assembling LEMS-type switches. Thus, all details regarding the structure of switch 100 may not be described in the present section, for reasons of brevity.

Permanent magnet 104 generates a first magnetic field. The magnetic field generated by permanent magnet 104 generally holds cantilever 102 in a particular state, depending on the magnetization direction of cantilever 102 (as more fully described below). Coil 106 is used to switch the magnetization direction of the cantilever 102, so as to switch the state of cantilever 102. When current passes through coil 106, a second magnetic field is generated according to the electromagnetic principle. The magnetic field generated by coil 106 magnetizes cantilever 102, which is suspended on hinges 112*a* and 112*b*. Hinges 112*a* and 112*b* may be torsion spring hinges, for example. The magnetization of cantilever 102 due to coil 106 is perpendicular to an axis through hinges 112*a* and 112*b* in order to tilt or rotate cantilever 102 in either direction. Thus, the magnetic field generated by coil 106 is used to switch the state of cantilever 102. Coil 106 can be any type of controllable magnetic field generation component, including an electromagnet.

Permanent magnet 104 has a magnetization direction of top to bottom (when oriented as shown in FIG. 1). Because of the repulsion and attraction arising between permanent magnet 104 and cantilever 102, the magnetized cantilever 102 tilts to either the front side or back side (when oriented as shown in FIG. 1). Substrate contacts 118 are formed on a substrate of switch 100. One of cantilever contacts 116*a* and 116*b* makes "closed" contact with either first substrate contact 118, or the other substrate contact (not shown in FIG. 1), depending on the direction in which cantilever 102 is tilted. The one of cantilever contacts 116*a* and 116*b* that is not in contact with a substrate contact is "open," and resides somewhere between cover plate 108 and the corresponding substrate contact.

In an embodiment, a short (i.e., temporary) current pulse through coil 106 is used to magnetize cantilever 102. This magnetization state of cantilever 102 is sustained after removing the current pulse. This effect can be used as a latching mechanism for switch 100 (although the present invention is not limited to latching switches). When current flow in coil 106 is reversed, the magnetization of cantilever 102 is reversed. Such reversed magnetization of cantilever 102 causes cantilever 102 to switch, rotate, or tilt in the opposite direction, and switch 100 thereby switches from one state to another. Thus, for example, if cantilever contact 116*a* and substrate contact 118 were previously closed, they become "open," and cantilever contact 116*b* and the respective substrate contact (not shown in FIG. 1), which were previously open, become "closed."

First and second hinges 112*a* and 112*b* at both ends of cantilever 102 sustain a torsion force (i.e., stress) when cantilever 102 is engaged with either of the substrate contacts. Furthermore, first and second hinges 112*a* and 112*b* sustain a stress due to the pull of the magnetic field of permanent magnet 104.

Because of a magnetic property of cantilever 102, and the magnetic field of permanent magnet 104, cantilever 102 is constantly attracted toward permanent magnet 104. This is indicated by a magnetic attraction 150 in FIG. 1. Magnetic attraction 150 of permanent magnet 104 causes an ever-present tensile stress across cantilever 102 and the structure of hinges 112*a* and 112*b*, regardless of whether switch 100 is in operation. The attractive force causes deformation of the beam (e.g., physical length and/or width) of cantilever 102. In tests of switches similar to switch 100, most of the switch devices showed significant deformation after approximately several thousands cycles of operation. Furthermore, the switches rarely passed 100,000 cycles. Furthermore, the deformation of cantilevers 102 caused changes in the operating condition and contact resistance of the switches. In most instances, the stress/deformation caused breakage of the hinges, and made the switch contacts remain continually open at both sides after some time (i.e., the switches were no longer able to close). Additionally, the deformation of the cantilever toward the permanent magnet generated 10-15 msec of switch bouncing at each contact after switching states.

Figure 2:
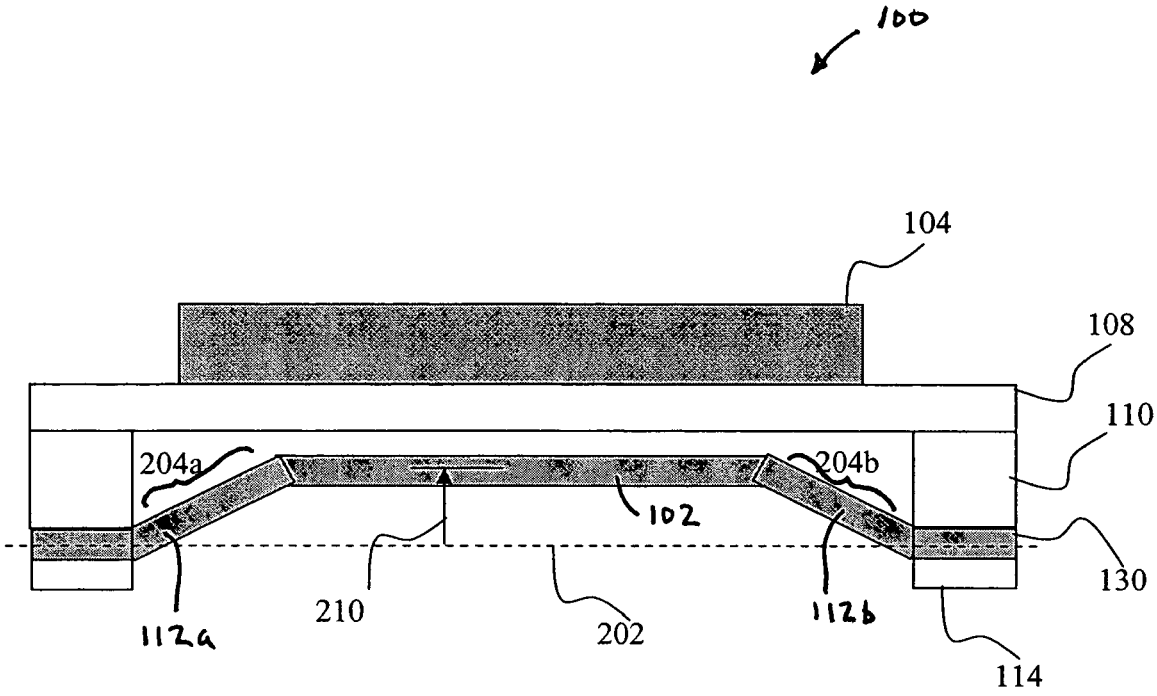
FIG. 2 shows a cross-sectional view of a switch after undergoing deformation due to the magnetic attraction of a permanent magnet.

FIG. 2 shows an example cross-sectional view of switch 100 after undergoing the above described deformation. Cantilever 102 is pulled upward (i.e., toward permanent magnet 104) a distance 210 from its initial position, shown as dotted line 202. In tests, such deformation caused about 75% of switch devices to have one or both of hinges 112*a* and 112*b* break, as indicated by break regions 204*a* and 204*b* in FIG. 2.

Figure 3:
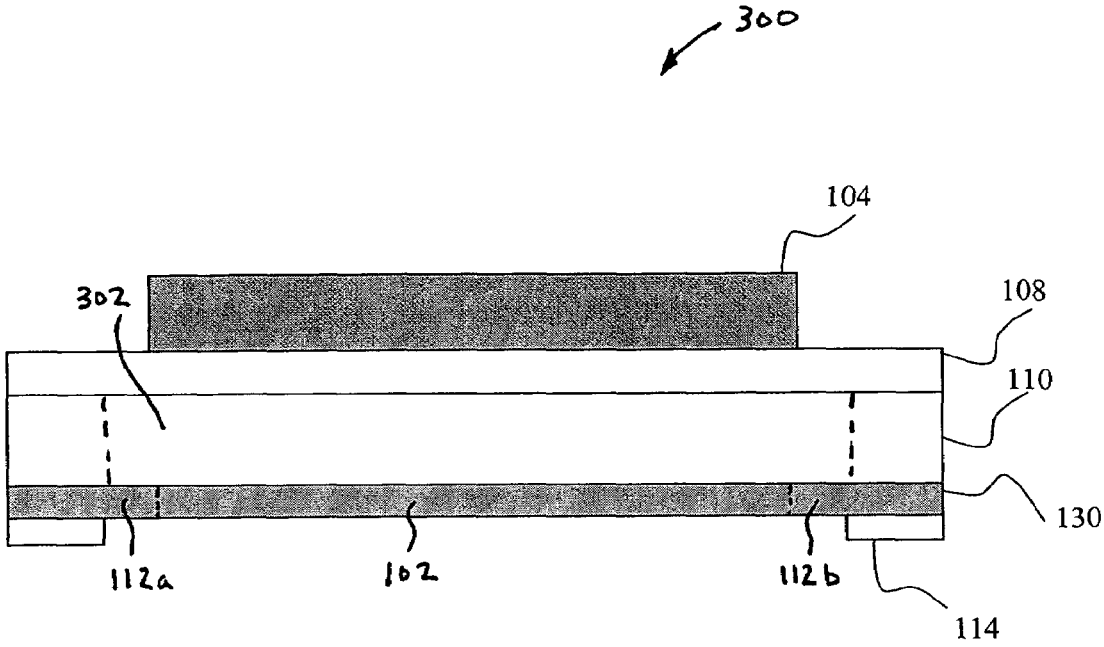
FIG. 3 shows a side view of a switch that includes a deformation suppressing bar member, according to an example embodiment of the present invention.
Figure 4A:
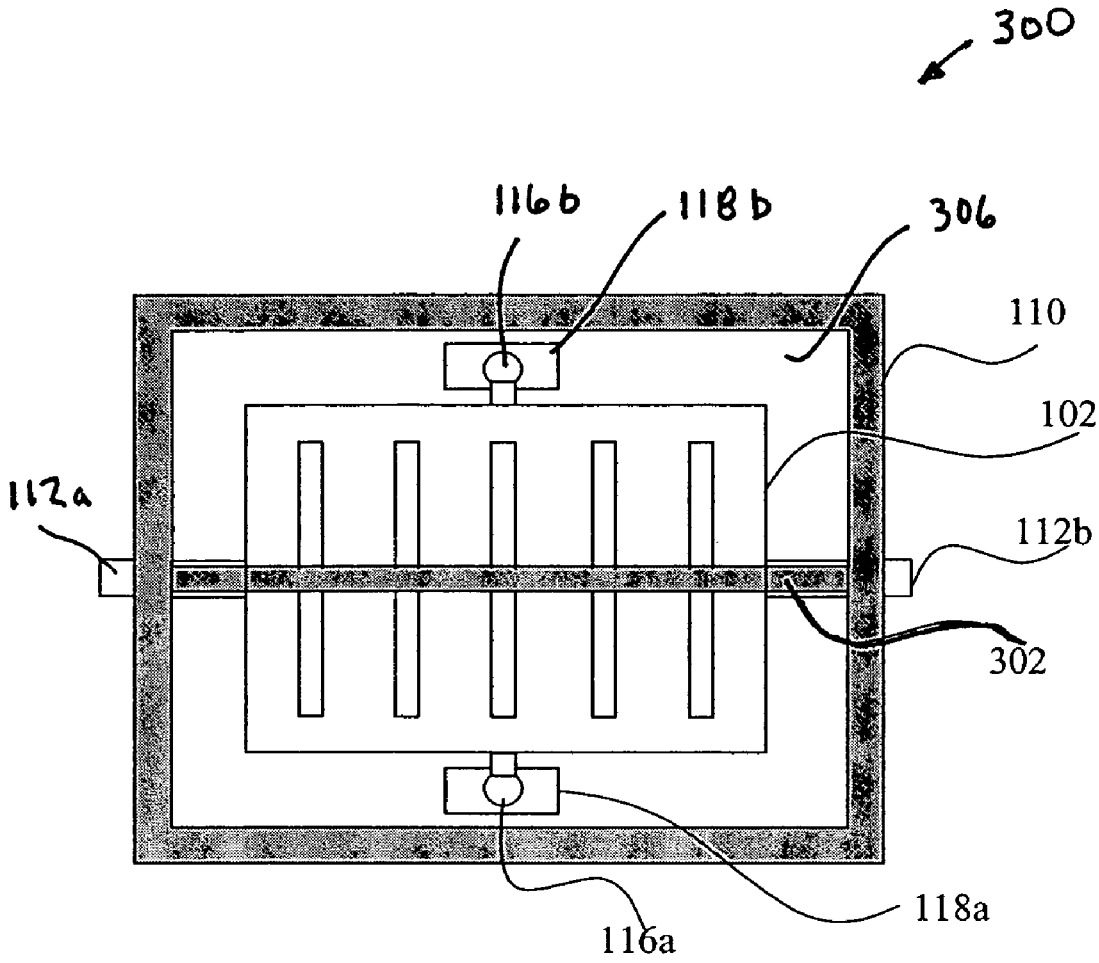
FIG. 4A shows a plan view of the switch of FIG. 3, according to an example embodiment of the present invention.

Embodiments of the present invention solve this above-described deformation problem suffered by conventional magnetically actuated switches. FIG. 3 shows a side view of an improved switch 300, according to an embodiment of the present invention. FIG. 4A shows a plan view of switch 300, according to an embodiment of the present invention. FIG. 4C shows a perspective view of the switch of FIG. 4A, according to an embodiment of the present invention. As shown in FIGS. 3, 4A, and 4C, switch 300 is generally similar to switch 100, shown in FIG. 1. However, switch 300 includes a deformation suppressing bar member 302.

As shown in the example of FIGS. 3, 4A, and 4C, cantilever 102 is formed in layer 130 between first and second flexible hinges 112*a* and 112*b*, which may be axially-aligned (as shown in FIG. 4A). First spacer layer 110, which is located between permanent magnet 104 and layer 130, has an opening 306. Opening 306 is formed to allow end portions of cantilever 102 to rotate/move into the plane of first spacer layer 110.

Figure 4B:
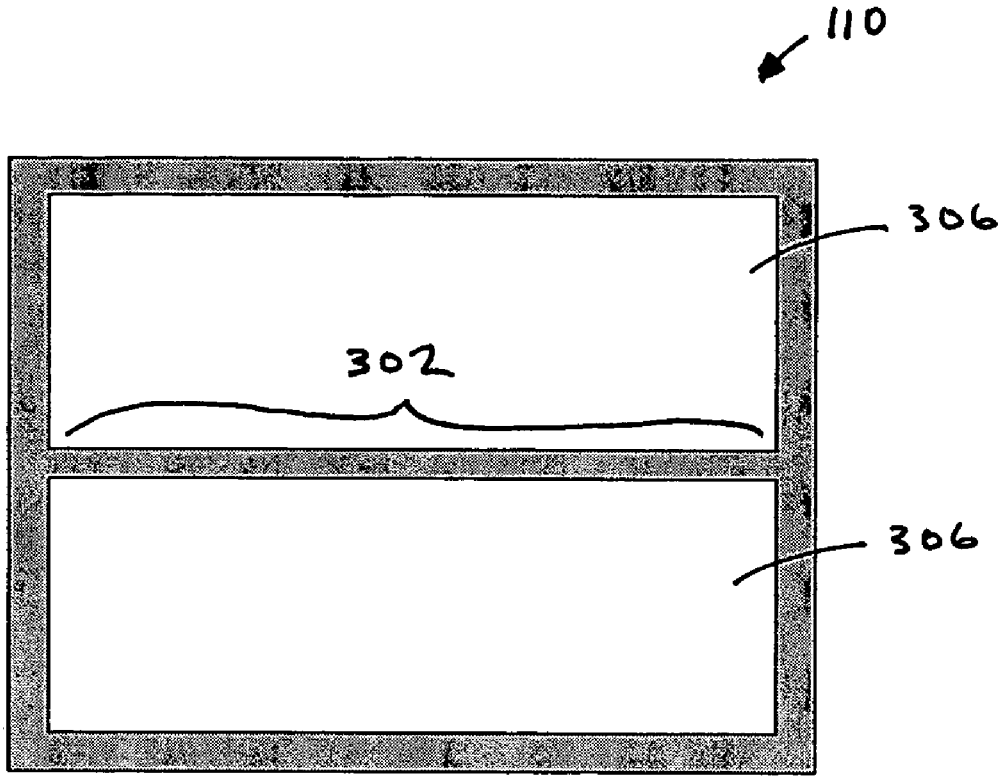
FIG. 4B shows a plan view of a spacer layer that includes a bar member, according to an embodiment of the present invention.
Figure 4C:
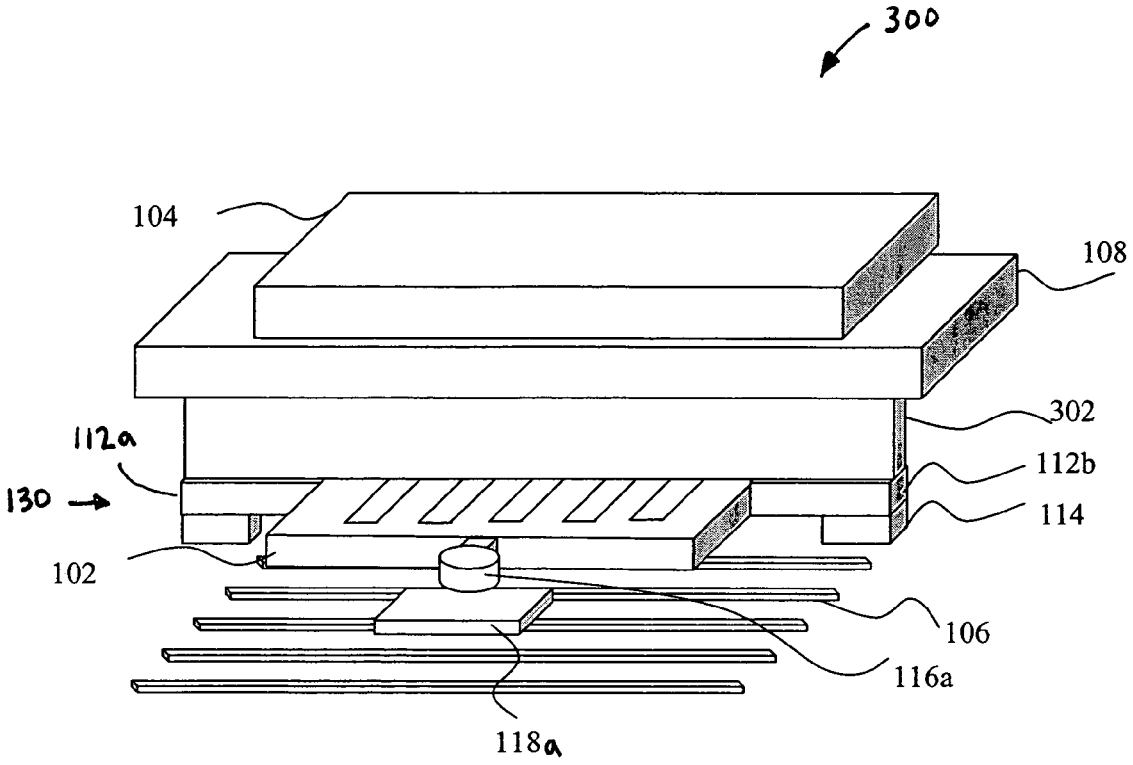
FIG. 4C shows a perspective view of the switch of FIG. 4A, according to an embodiment of the present invention.

FIG. 4B shows a plan view of first spacer layer 110 of FIGS. 3, 4A, and 4C, with bar member 302, according to an embodiment of the present invention. In the present example, bar member 302 is fabricated in first spacer layer 110 to be positioned along the axis line of first and second hinges 112*a* and 112*b*. Bar member 302 maintains a distance between cover plate layer 108 (or other similar layer) and cantilever 102. This distance can be designed to have any value, depending on the particular application and/or switch size. Bar member 302 blocks the pulling-up/deformation/stress of cantilever 102 by the magnetic attraction of permanent magnet 104 due to its magnetic field. Thus, during operation of switch 300, bar member 302 is typically at least partially in contact with cantilever 102, or is positioned closely to cantilever 102 with a small gap between them.

Through the use of bar member 302, it is possible to protect cantilever 102 from deformation due to the magnetic attraction of permanent magnet 104, extending the life time of switch 300. In tests on switches similar to switch 300, the switch structure survived over 2 million switching cycles under the same operating conditions as used in the tests described above for the conventional switch structure (e.g., switch 100). Furthermore, suppression of this deformation also allowed for shorter switch bouncing times. For example, switches including a bar member showed 1-2 msec of bouncing, which is much shorter than for the switches described above, which did not include a bar member.

In the example of FIGS. 3 and 4A-4C, a cross-bar type bar member 302 is formed in first spacer layer 110, which extends completely across opening 306. In alternative embodiments, a bar member 302 extends partially across opening 306, from one or both ends. Thus, in some embodiments, a bar member 302 can be fabricated as a portion of first spacer layer 110 without using additional material or layers in switch 300. Alternatively, bar member 302 can be fabricated independently of first spacer layer 110.

Further alternative bar member 302 embodiments are also possible, including bar members that are fabricated as part of, or are attached to cover plate layer 108 (or other similar layer), and extend into opening 306 of first spacer layer 110. Still further, cover plate layer 108 can have a cavity formed therein, with bar member 302 crossing all or part of the cavity, without needing first spacer layer 110.

Figure 4D:
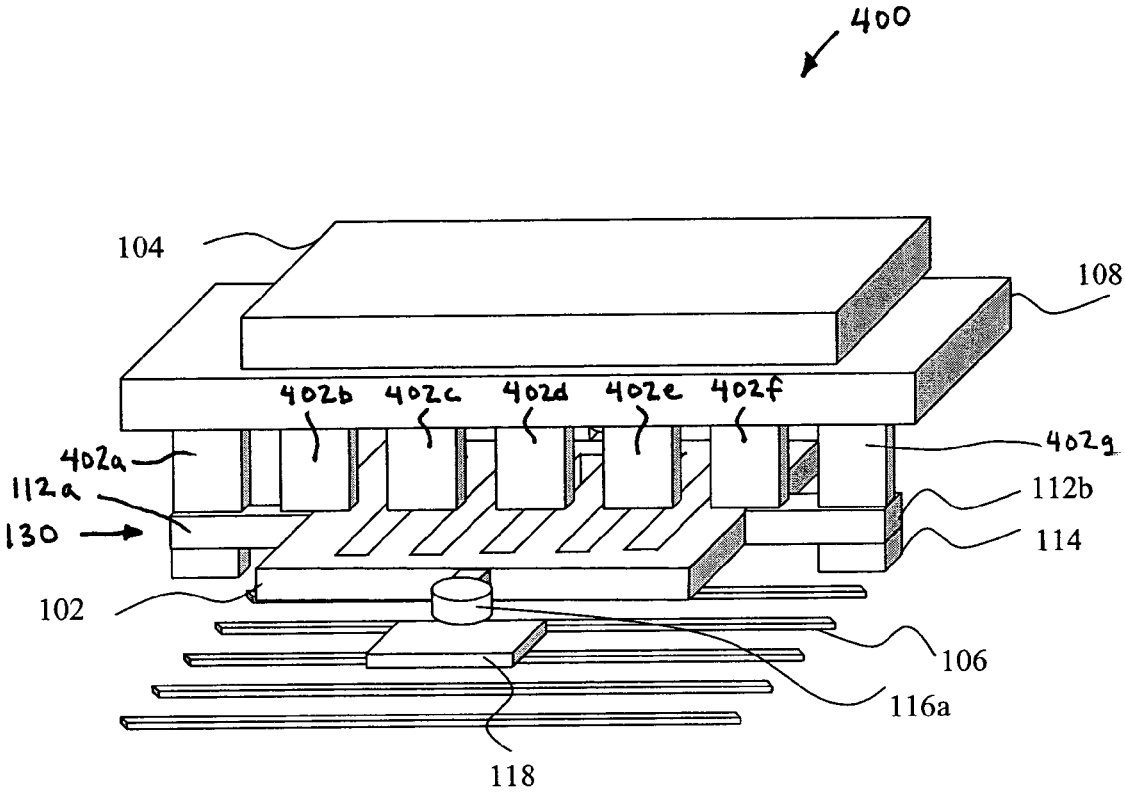
FIG. 4D shows a perspective view of a switch having a bar member that has a plurality of portions, according to an embodiment of the present invention.

In further example embodiments, bar member 302 can be a single cross-bar type (i.e., crossing the length of cantilever 102), can be multiple cross-bar segments that extend partially across the length of cantilever 102, or can be tabs/posts protruding downward from cover plate layer 108. For example, FIG. 4D shows a switch 400 that is generally similar to switch 300. However, switch 400 has a plurality of posts 402*a-g* that function as a bar member. As shown in FIG. 4D, posts 402*a-g* each extend downward from cover plate layer 108 toward cantilever 102. In the example of FIG. 4D, posts 402*a-g* are aligned along the axis of hinges 112*a* and 112*b* through cantilever 102. Any number and size of tabs/posts can be used in embodiments of the present invention. Other configurations for bar member 302 are also within the scope of the present invention. Bar member 302 can be made from materials used to make other layers of switch 300, or other materials. Some example materials are described below in the following subsection, and elsewhere herein.

In FIGS. 3, 4A, and 4C, bar member 302 is formed to reside parallel to the hinge axis line right above the center line or portion of cantilever 102. A width of bar member 302 can be selected for a particular application. A bar member 302 having a width that is wider than hinges 112*a* and 112*b* may disturb movement of cantilever 102, and may therefore decrease the switching frequency of switch 300. A bar member 302 having a width similar or narrower than hinges 112*a* and 112*b* can typically allow for greater freedom of movement for cantilever 102, and therefore faster switching frequencies for switch 300.

Figure 5:
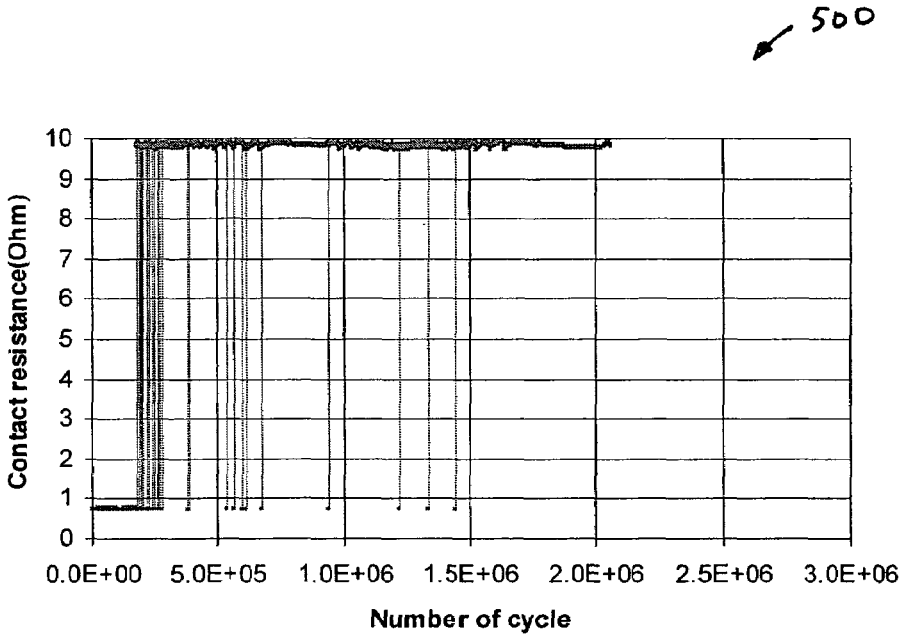
FIG. 5 shows a plot (contact resistance vs. cycles) of test results related to the mechanical life time of switch devices that do not include a bar member.

FIG. 5 shows a plot 500 (contact resistance vs. cycles) of test results related to the mechanical life time of switch devices that do not include a bar member, such as switch 100. FIG. 5 indicates that the contact resistance increases to 10 Ohms (indicating an open contact) after 200,000 switching cycles. This is far below the life time cycles desired for a typical cantilever switch. After 200,000 cycles, typically the torsion hinges of the switch devices were broken by mechanical stress due at least in part to deformation (as described above), and the switch devices stopped responding.

Figure 6:
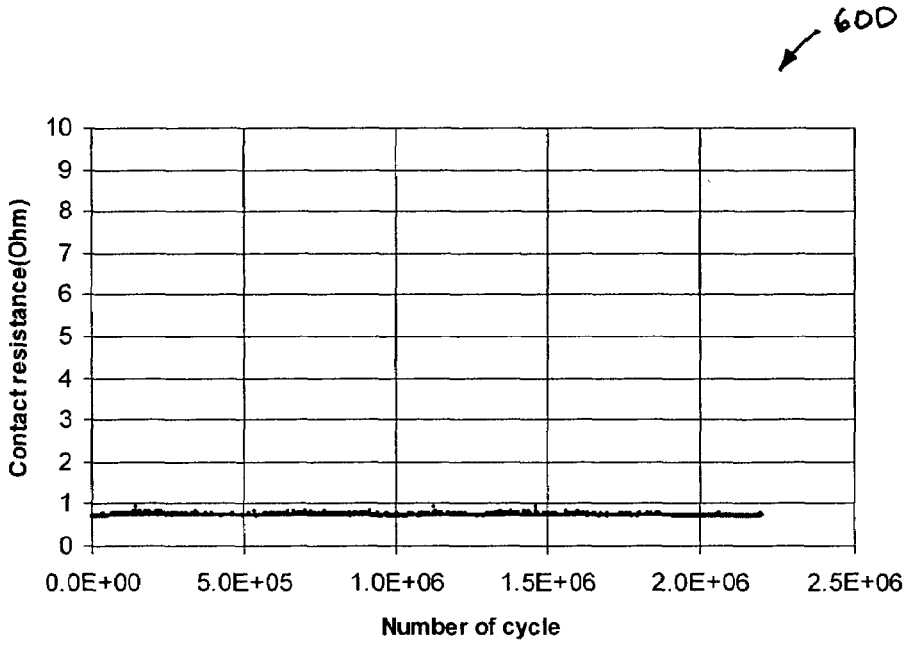
FIG. 6 shows a plot, similar to the plot shown in FIG. 5, of test results related to the mechanical life time of switch devices that do include a bar member, according to embodiments of the present invention.

FIG. 6 shows a plot 600 similar to plot 500 of test results related to the mechanical life time of switch devices that do include a bar member, such as switch 300. As shown in FIG. 6, the life time cycles of the tested switches reached 2 million cycles, without deformation and resulting breakdown.

As described above, the bar member of the present invention is applicable to any type of micro-magnetic switch/relay. For illustrative purposes, the following subsection describes LEMS-type switch structures, in which the present invention can be implemented.

Assembling Laminated Electro-Mechanical Structures According to the Present Invention Embodiments for making and assembling laminated electro-mechanical systems and structures according to the present invention are described in detail as follows. These implementations are described herein for illustrative purposes, and are not limiting. The laminated electro-mechanical systems and structures of the present invention, as described in this section, can be assembled in alternative ways, as would be apparent to persons skilled in the relevant art(s) from the teachings herein.

FIGS. 7A-7C show views of a laminated electro-mechanical system 700, according to an embodiment of the present invention. FIG. 7A shows a plan view of laminated electro-mechanical system 700. FIGS. 7B and 7C show cross-sectional views of laminated electro-mechanical system 700. For illustrative purposes, laminated electro-mechanical system 700 is shown as including a micro-magnetic latching switch. However, it is noted that the present invention as described herein is also applicable fabrication of latching switches with other actuation mechanisms, and to fabrication of other larger scale and micro-machined device types.

As shown in FIGS. 7A-7C, laminated electro-mechanical system 700 includes a high-permeability (e.g., permalloy) layer 1, an electro-magnet or coil 2 having contacts 21 and 22, bottom contacts 31 and 32, a permanent magnet 4, a cantilever assembly 5, and further lamination layers. Cantilever assembly includes contacts 53 and 54, a cantilever body 52 (e.g., made of a soft magnetic material such as a permalloy), and contact tips 55 and 56, and is supported by torsion flexures 51. Cantilever body 52 is a movable element that is positioned inside a cavity 702 so that it can toggle freely between contacts 31 and 32 during operation of the latching switch. Example operation of the latching switch is further described above.

To fabricate the latching switch shown in FIGS. 7A-7C, various patterns and openings are first defined and formed on the structural lamination layers or built up with other materials. As shown in FIGS. 7B and 2A, laminated electro-mechanical system 700 includes a structural layer formed substantially by permanent magnet 4, a first substrate layer 704, a first spacer layer 706, a movable element layer 708, a second spacer layer 710, a coil layer 712, and a second substrate layer 714.

The structural layers can be formed from a variety of materials. For example, in an embodiment, the structural layers can be formed from thin films that are capable of at least some flexing, and have large surface areas. Alternatively, structural layers can be formed from other materials. The structural layers can be electrically conductive or non-conductive. For example, the structural layers can be formed from inorganic or organic substrate materials, including plastics, glass, polymers, dielectric materials, etc. Example organic substrate materials include "BT," which includes a resin called bis-maleimide triazine, "FR-4," which is a fire-retardant epoxy resin-glass cloth laminate material, and/or other materials. In electrically conductive structural layer embodiments, structural layers can be formed from a metal or combination of metals/alloy, or from other electrically conductive materials.

As shown in FIG. 7B, the structural layers are aligned and stacked together to form a stack 716. The structural layers are attached to each other in the stack with an adhesive material (not shown). The adhesive material may be an adhesive tape, or an interfacial glue layer, such as an epoxy (e.g. a B-stage epoxy) applied/located between the structural layers. If the adhesive material requires curing, such as thermal curing, stack 716 can be heated to a suitable temperature to cure the adhesive material, and attach the structural layers together.

As shown in FIGS. 7B and 7C, a cavity 702 is formed aligning the openings through first and second spacer layers 706 and 710 on either side of movable element layer 708. Cavity 702 allows the movable element of movable element layer 708 (e.g., cantilever body 52) to move freely to contact one or more electrical contacts, such as contacts 31 and 32 shown in FIG. 7A. Contacts 31 and 32 are formed on coil layer 712 in the example of FIGS. 7A-7C.

One or more vias may be formed in structural layers to allow electrical contact between elements in system 700 and elements exterior to system 700. As shown in FIG. 7B, for example, vias 41 and 42 electrically couple contact areas 31 and 32, respectively, to contact pads 718 and 720 formed on a surface of second substrate layer 714. Furthermore, as shown in FIG. 7C, vias 722 and 724 electrically couple contacts 53 and 54 to contact pads 726 and 728 formed on a surface of second substrate layer 714. Vias may be formed in any number of one or more structural layers. Vias through multiple layers can be aligned to allow electrical connections between any structural layers.

Note that although a single latching switch is shown in the embodiment of FIGS. 7A-7C, it should be understood that multiple micro-mechanical devices can be patterned on the lamination layers and batch fabricated. The multiple micro-mechanical devices can be left together, or can be separated by cutting.

Figure 8:
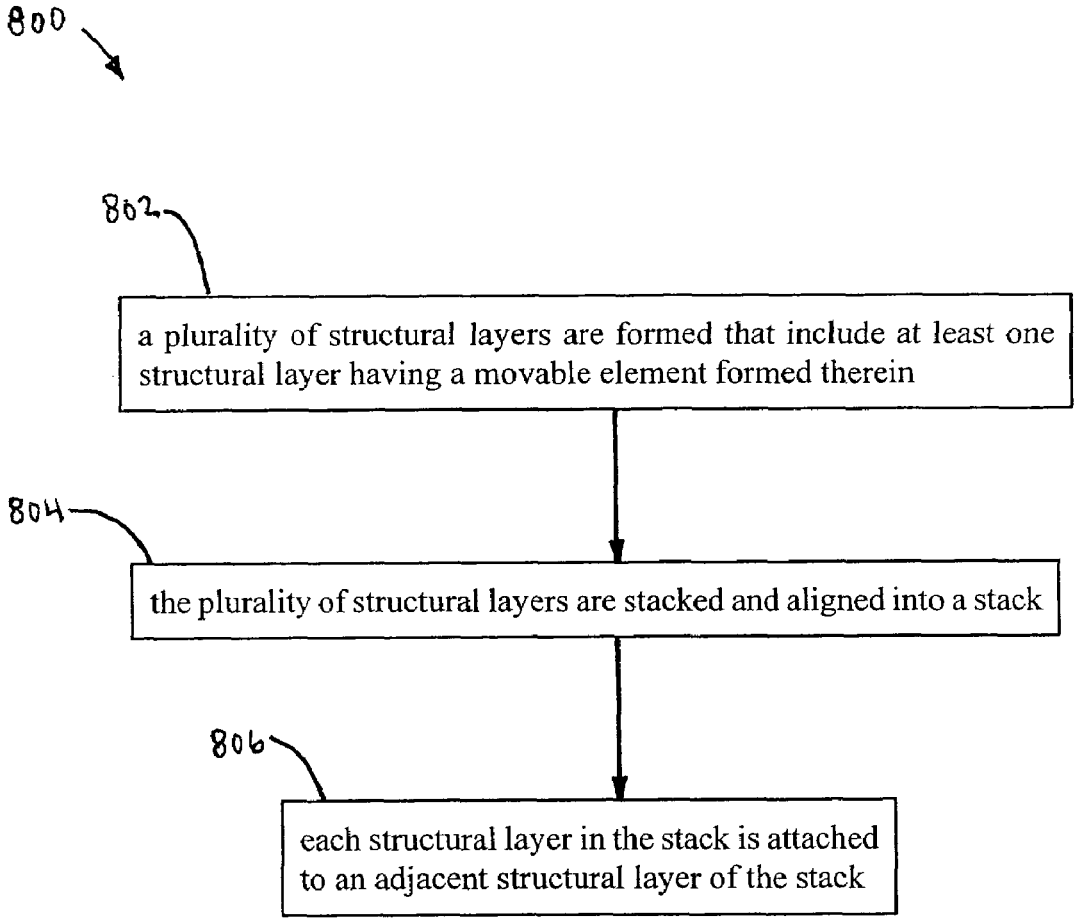
FIG. 8 shows a flowchart for making or assembling laminated electro-mechanical structures, according to an example embodiment of the present invention.

FIG. 8 shows a flowchart 800 providing steps for making micro-machined structures of the present invention, according to an example embodiment. The steps of FIG. 8 do not necessarily have to occur in the order shown, as will be apparent to persons skilled in the relevant art(s) based on the teachings herein. Alternative ways for making micro-machined structures of the present invention will be apparent to persons skilled in the relevant art(s) based upon the teachings herein. These alternative ways are also within the scope and spirit of the present invention.

As described herein, numerous electrical and mechanical device types may be made according to the laminated electro-mechanical systems and structures of the present invention. These devices can be made in a wide range of sizes, including small-scale micro-mechanical devices and larger scale devices.

For illustrative purposes, the following sections describe operation of example micro-magnetic latching switches. Note that the present invention is not limited to latching switches, but is also applicable to non-latching switches. Furthermore, the present invention is also applicable to micro-magnetic switches that operate in ways different than described below.

Overview of a Latching Switch

Figure 9A:
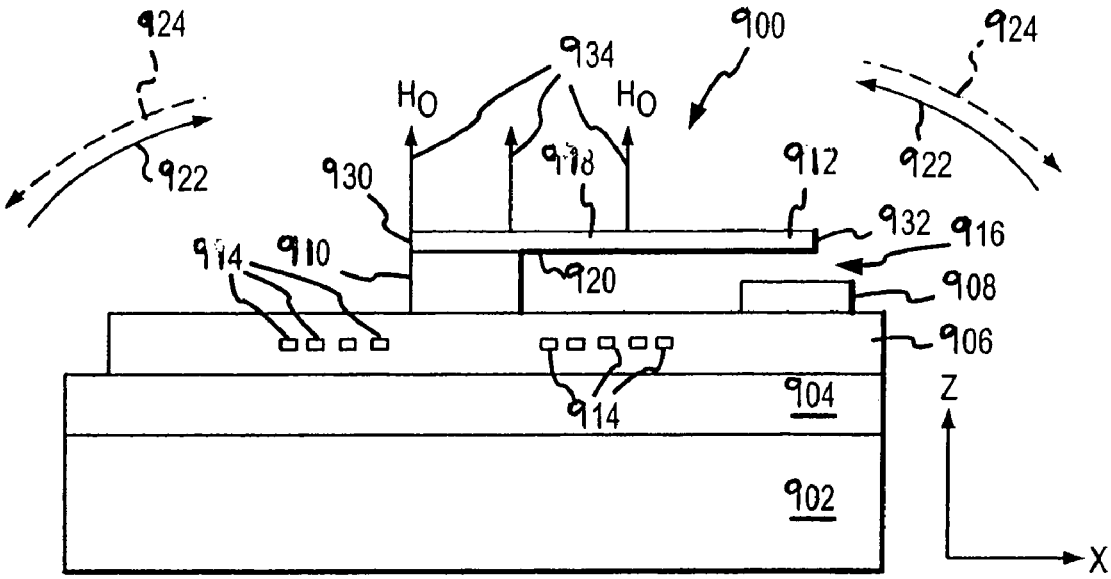
FIGS. 9A and 9B are side and top views, respectively, of an exemplary embodiment of a switch.
Figure 9B:
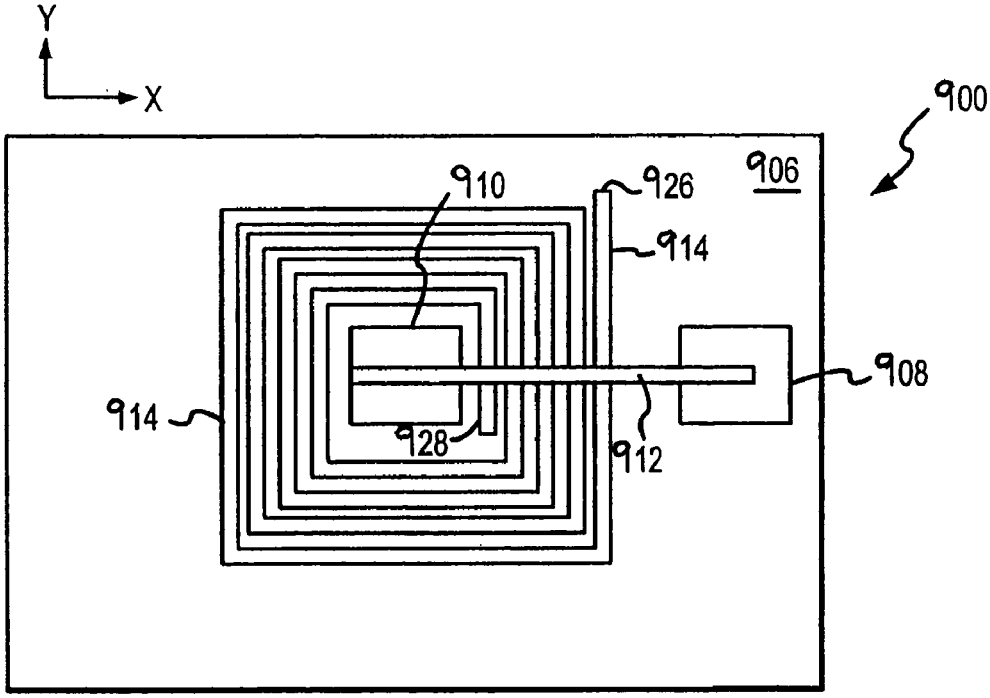

FIGS. 9A and 9B show side and top views, respectively, of a latching switch. The terms switch and device are used herein interchangeably to described the structure of the present invention. With reference to FIGS. 9A and 9B, an exemplary latching relay 900 suitably includes a magnet 902, a substrate 904, an insulating layer 906 housing a conductor 914, a contact 908 and a cantilever (moveable element) 912 positioned or supported above substrate by a staging layer 910.

Magnet 902 is any type of magnet such as a permanent magnet, an electromagnet, or any other type of magnet capable of generating a magnetic field H0 934, as described more fully below. By way of example and not limitation, the magnet 902 can be a model 59-P09213T001 magnet available from the Dexter Magnetic Technologies corporation of Fremont, Calif., although of course other types of magnets could be used. Magnetic field 934 can be generated in any manner and with any magnitude, such as from about 1 Oersted to 104 Oersted or more. The strength of the field depends on the force required to hold the cantilever in a given state, and thus is implementation dependent. In the exemplary embodiment shown in FIG. 9A, magnetic field H0 934 can be generated approximately parallel to the Z axis and with a magnitude on the order of about 370 Oersted, although other embodiments will use varying orientations and magnitudes for magnetic field 934. In various embodiments, a single magnet 902 can be used in conjunction with a number of relays 900 sharing a common substrate 904.

Substrate 904 is formed of any type of substrate material such as silicon, gallium arsenide, glass, plastic, metal or any other substrate material. In various embodiments, substrate 904 can be coated with an insulating material (such as an oxide) and planarized or otherwise made flat. In various embodiments, a number of latching relays 900 can share a single substrate 904. Alternatively, other devices (such as transistors, diodes, or other electronic devices) could be formed upon substrate 904 along with one or more relays 900 using, for example, conventional integrated circuit manufacturing techniques. Alternatively, magnet 902 could be used as a substrate and the additional components discussed below could be formed directly on magnet 902. In such embodiments, a separate substrate 904 may not be required.

Insulating layer 906 is formed of any material such as oxide or another insulator such as a thin-film insulator. In an exemplary embodiment, insulating layer is formed of Probimide 7510 material. Insulating layer 906 suitably houses conductor 914. Conductor 914 is shown in FIGS. 9A and 9B to be a single conductor having two ends 926 and 928 arranged in a coil pattern. Alternate embodiments of conductor 914 use single or multiple conducting segments arranged in any suitable pattern such as a meander pattern, a serpentine pattern, a random pattern, or any other pattern. Conductor 914 is formed of any material capable of conducting electricity such as gold, silver, copper, aluminum, metal or the like. As conductor 914 conducts electricity, a magnetic field is generated around conductor 914 as discussed more fully below.

Cantilever (moveable element) 912 is any armature, extension, outcropping or member that is capable of being affected by magnetic force. In the embodiment shown in FIG. 9A, cantilever 912 suitably includes a magnetic layer 918 and a conducting layer 920. Magnetic layer 918 can be formulated of permalloy (such as NiFe alloy) or any other magnetically sensitive material. Conducting layer 920 can be formulated of gold, silver, copper, aluminum, metal or any other conducting material. In various embodiments, cantilever 912 exhibits two states corresponding to whether relay 900 is "open" or "closed", as described more fully below. In many embodiments, relay 900 is said to be "closed" when a conducting layer 920, connects staging layer 910 to contact 908. Conversely, the relay may be said to be "open" when cantilever 912 is not in electrical contact with contact 908. Because cantilever 912 can physically move in and out of contact with contact 908, various embodiments of cantilever 912 will be made flexible so that cantilever 912 can bend as appropriate. Flexibility can be created by varying the thickness of the cantilever (or its various component layers), by patterning or otherwise making holes or cuts in the cantilever, or by using increasingly flexible materials.

Alternatively, cantilever 912 can be made into a "hinged" arrangement. Although of course the dimensions of cantilever 912 can vary dramatically from implementation to implementation, an exemplary cantilever 912 suitable for use in a micro-magnetic relay 900 can be on the order of 10-1000 microns in length, 1-40 microns in thickness, and 2-600 microns in width. For example, an exemplary cantilever in accordance with the embodiment shown in FIGS. 9A and 9B can have dimensions of about 600 microns×10 microns×50 microns, or 1000 microns×600 microns×25 microns, or any other suitable dimensions.

Contact 908 and staging layer 910 are placed on insulating layer 906, as appropriate. In various embodiments, staging layer 910 supports cantilever 912 above insulating layer 906, creating a gap 916 that can be vacuum or can become filled with air or another gas or liquid such as oil. Although the size of gap 916 varies widely with different implementations, an exemplary gap 916 can be on the order of 1-100 microns, such as about 20 microns, Contact 908 can receive cantilever 912 when relay 900 is in a closed state, as described below. Contact 908 and staging layer 910 can be formed of any conducting material such as gold, gold alloy, silver, copper, aluminum, metal or the like. In various embodiments, contact 908 and staging layer 910 are formed of similar conducting materials, and the relay is considered to be "closed" when cantilever 912 completes a circuit between staging layer 910 and contact 908. In certain embodiments wherein cantilever 912 does not conduct electricity, staging layer 910 can be formulated of non-conducting material such as Probimide material, oxide, or any other material. Additionally, alternate embodiments may not require staging layer 910 if cantilever 912 is otherwise supported above insulating layer 906.

Principle of Operation of a Latching Switch

When it is in the "down" position, the cantilever makes electrical contact with the bottom conductor, and the switch is "on" (also called the "closed" state). When the contact end is "up", the switch is "off" (also called the "open" state). These two stable states produce the switching function by the moveable cantilever element. The permanent magnet holds the cantilever in either the "up" or the "down" position after switching, making the device a latching relay. A current is passed through the coil (e.g., the coil is energized) only during a brief (temporary) period of time to transition between the two states.

(i) Method to Produce Bi-stability

Figure 10:
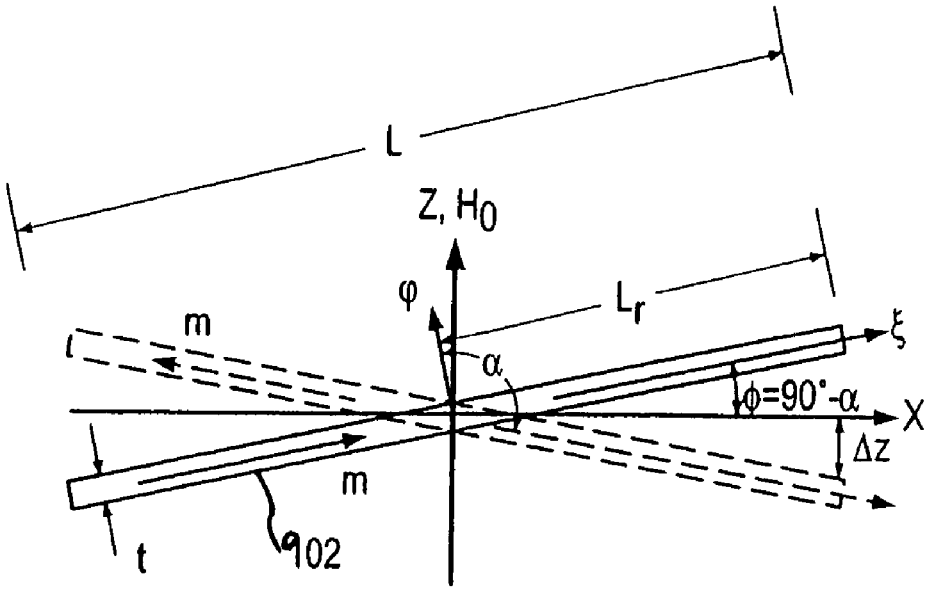
FIG. 10 illustrates the principle by which bi-stability is produced.

The principle by which bi-stability is produced is illustrated with reference to FIG. 2. When the length L of a permalloy cantilever 912 is much larger than its thickness t and width (w, not shown), the direction along its long axis L becomes the preferred direction for magnetization (also called the "easy axis"). When a major central portion of the cantilever is placed in a uniform permanent magnetic field, a torque is exerted on the cantilever. The torque can be either clockwise or counterclockwise, depending on the initial orientation of the cantilever with respect to the magnetic field. When the angle ($\alpha$) between the cantilever axis ($\xi$) and the external field (H0) is smaller than 90°, the torque is counterclockwise; and when $\alpha$ is larger than 90°, the torque is clockwise. The bi-directional torque arises because of the bi-directional magnetization (i.e., a magnetization vector "m" points one direction or the other direction, as shown in FIG. 10) of the cantilever (m points from left to right when $\alpha<90°$, and from right to left when $\alpha>90°$). Due to the torque, the cantilever tends to align with the external magnetic field (H0). However, when a mechanical force (such as the elastic torque of the cantilever, a physical stopper, etc.) preempts to the total realignment with H0, two stable positions ("up" and "down") are available, which forms the basis of latching in the switch.

(ii) Electrical Switching

If the bi-directional magnetization along the easy axis of the cantilever arising from H0 can be momentarily reversed by applying a second magnetic field to overcome the influence of (H0), then it is possible to achieve a switchable latching relay. This scenario is realized by situating a planar coil under or over the cantilever to produce the required temporary switching field. The planar coil geometry was chosen because it is relatively simple to fabricate, though other structures (such as a wrap-around, three dimensional type) are also possible. The magnetic field (Hcoil) lines generated by a short current pulse loop around the coil. It is mainly the $\xi$-component (along the cantilever, see FIG. 10) of this field that is used to reorient the magnetization (magnetization vector "m") in the cantilever. The direction of the coil current determines whether a positive or a negative $\xi$-field component is generated. Plural coils can be used. After switching, the permanent magnetic field holds the cantilever in this state until the next switching event is encountered. Since the $\xi$-component of the coil-generated field (Hcoil-$\xi$) only needs to be momentarily larger than the $\xi$-component [H0$\xi$~H0 cos($\alpha$)=H0 sin($\phi$), $\alpha$=90°−$\phi$] of the permanent magnetic field and $\phi$ is typically very small (e.g., $\phi \leqq 5°$), switching current and power can be very low, which is an important consideration in micro relay design.

The operation principle can be summarized as follows: A permalloy cantilever in a uniform (in practice, the field can be just approximately uniform) magnetic field can have a clockwise or a counterclockwise torque depending on the angle between its long axis (easy axis, L) and the field. Two bi-stable states are possible when other forces can balance die torque. A coil can generate a momentary magnetic field to switch the orientation of magnetization (vector m) along the cantilever and thus switch the cantilever between the two states.

Relaxed Alignment of Magnets

To address the issue of relaxing the magnet alignment requirement, the inventors have developed a technique to create perpendicular magnetic fields in a relatively large region around the cantilever. The invention is based on the fact that the magnetic field lines in a low permeability media (e.g., air) are basically perpendicular to the surface of a very high permeability material (e.g., materials that are easily magnetized, such as permalloy). When the cantilever is placed in proximity to such a surface and the cantilever's horizontal plane is parallel to the surface of the high permeability material, the above stated objectives can be at least partially achieved. The generic scheme is described below, followed by illustrative embodiments of the invention.

The boundary conditions for the magnetic flux density (B) and magnetic field (H) follow the following relationships:

$$B2\cdot n=B1\cdot n,\ B2\times n=(\mu 2/\mu 1)B1\times n$$

or $$H2\cdot n=(\mu 1/\mu 2)H1\cdot n,\ H2\times n=H1\times n$$

Figure 11:
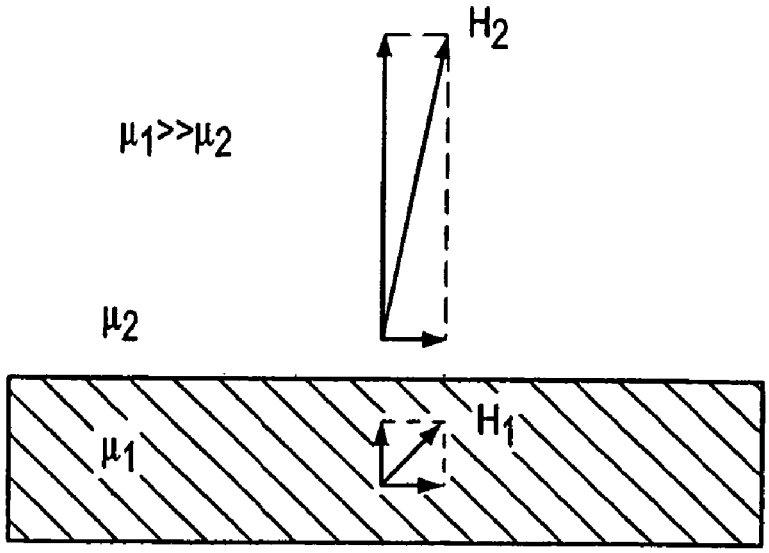
FIG. 11 illustrates the boundary conditions on the magnetic field (H) at a boundary between two materials with different permeability (1>>2).

If $\mu 1 >> \mu 2$, the normal component of H2 is much larger than the normal component of H1, as shown in FIG. 11. In the limit $(\mu 1/\mu 2)\rightarrow\infty$, the magnetic field H2 is normal to the boundary surface, independent of the direction of H1 (barring the exceptional case of H1 exactly parallel to the interface). If the second media is air ($\mu 2=1$), then B2=$\mu$0 H2, so that the flux lines B2 will also be perpendicular to the surface. This property is used to produce magnetic fields that are perpendicular to the horizontal plane of the cantilever in a micro-magnetic latching switch and to relax the permanent magnet alignment requirements.

This property, where the magnetic field is normal to the boundary surface of a high-permeability material, and the placement of the cantilever (i.e., soft magnetic) with its horizontal plane parallel to the surface of the high-permeability material, can be used in many different configurations to relax the permanent magnet alignment requirement.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A laminated electro-magnetic relay, comprising:

a stack of layers, including:

a permanent magnet layer that produces a first magnetic field;

a layer having a movable element held between a pair of axially-aligned, rotationally flexible hinges;

a first spacer layer between said permanent magnet layer and said layer having said movable element, wherein said first spacer layer has an opening formed therein and a bar member, wherein said opening is formed to allow at least one end portion of said movable element to move into a plane of said first spacer layer; and a layer having a coil that produces a second magnetic field to switch said moveable element between first and second stable states;

wherein said bar member is: (1) positioned across said opening; (2) parallel to and in alignment with said pair of axially-aligned, rotationally flexible hinges; and (3) adjacent to a central portion of said movable element;

wherein at least said central portion of said movable element is magnetically attracted toward said permanent magnet layer;

whereby said bar member physically prevents said central portion of said movable element from flexing toward said permanent magnet layer due to said magnetic attraction.

2. The relay of claim 1, wherein said relay is a latching relay.

3. The relay of claim 1, wherein said relay is non-latching.

4. The relay of claim 1, wherein only temporary application of said second magnetic field is required to cause said moveable element to switch between said first and second stable states.

5. The relay of claim 1, wherein said stack further comprises:

a second spacer layer having an opening formed therein to allow at least one end portion of said movable element to move into a plane of said second spacer layer;

wherein said layer that includes said movable element is located between said first and said second spacer layers.

6. The relay of claim 1, wherein said stack further comprises a cover plate layer;

wherein said cover plate layer is located between said first spacer layer and said permanent magnet layer.

7. The relay of claim 1, wherein each said at least one end portion of said movable element has an electrical contact.

8. The relay of claim 1, wherein said first spacer layer is made from at least one of a thin film, an inorganic substrate material, an organic substrate material, a plastic, a glass, a polymer, and a dielectric material.

9. The relay of claim 1, wherein said layer having said movable element is made from at least one of a thin film, an inorganic substrate material, an organic substrate material, a plastic, a glass, a polymer, and a dielectric material.

10. The relay of claim 1, wherein said layer having said coil is made from at least one of a thin film, an inorganic substrate material, an organic substrate material, a plastic, a glass, a polymer, and a dielectric material.

11. An electro-magnetic relay, comprising:

a permanent magnet that produces a first magnetic field;

a movable element held between a pair of axially-aligned, rotationally flexible hinges;

a space between said permanent magnet and said movable element to allow at least one end portion of said movable element to move toward said permanent magnet;

a bar member positioned in said space; and a coil that produces a second magnetic field to switch said moveable element between first and second stable states;

wherein said bar member is: (1) positioned across said space; (2) parallel to and in alignment with said pair of axially-aligned, rotationally flexible hinges; and (3) adjacent to a central portion of said moveable element;

wherein at least said central portion of said movable element is magnetically attracted toward said permanent magnet;

whereby said bar member physically prevents said central portion of said movable element from flexing toward said permanent magnet due to said magnetic attraction.

12. The relay of claim 11, wherein said relay is a latching relay.

13. The relay of claim 11, wherein said relay is non-latching.

14. The relay of claim 11 wherein only temporary application of said second magnetic field is required to cause said moveable element to switch between said first and second stable states.

15. The relay of claim 11, wherein said stack further comprises:

a second space to allow at least one end portion of said movable element to move away from said permanent magnet.

16. The relay of claim 11, further comprising a cover plate between said space and said permanent magnet, wherein said permanent magnet is attached to said cover plate.

17. The relay of claim 11, wherein each said at least one end portion of said movable element has an electrical contact.

18. The relay of claim 11, wherein said movable element is made from at least one of a thin film, an inorganic substrate material, an organic substrate material, a plastic, a glass, a polymer, and a dielectric material.

19. A laminated electro-magnetic relay, comprising:

a stack of layers, including:

a permanent magnet layer that produces a first magnetic field;

a layer having a movable element held between a pair of axially-aligned, rotationally flexible hinges;

a spacer layer between said permanent magnet layer and said layer having said movable element, wherein said spacer layer has an opening formed therein, wherein said opening is formed to allow at least one end portion of said movable element to move into a plane of said spacer layer; and a layer having a coil that produces a second magnetic field to switch said moveable element between first and second stable states;

a cover layer between said permanent magnet layer and said spacer layer, said cover layer having a bar member attached thereto that resides in said opening;

wherein at least said central portion of said movable element is magnetically attracted toward said permanent magnet layer;

whereby said bar member physically prevents said central portion of said movable element from flexing toward said permanent magnet layer due to said magnetic attraction.

20. The relay of claim 19, wherein said bar member is a single piece structure.

21. The relay of claim 19, wherein said bar member comprises a plurality of separate portions.

22. The relay of claim 19, wherein said separate portions are posts.

* * * * *